US006419987B1

(12) United States Patent
Bauer et al.

(10) Patent No.: US 6,419,987 B1
(45) Date of Patent: Jul. 16, 2002

(54) METHOD FOR PROVIDING A HIGH VISCOSITY COATING ON A MOVING WEB AND ARTICLES MADE THEREBY

(75) Inventors: Charles L. Bauer, Webster; Lori Shaw-Klein; Joseph Reczek, both of Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/466,345

(22) Filed: Dec. 17, 1999

(51) Int. Cl.[7] ..... B05D 1/38

(52) U.S. Cl. ..... 427/302; 427/301; 427/333; 427/393.5; 427/412.5; 427/419.2; 427/419.7

(58) Field of Search ..... 427/301, 302, 427/303, 333, 322, 411, 412.5, 419.7, 393.5, 419.2

(56) References Cited

U.S. PATENT DOCUMENTS 3,239,338 A * 3/1966 Rogers ..... 430/216
3,801,321 A * 4/1974 Evans et al. ..... 96/48 HD
4,558,003 A * 12/1985 Sagawa ..... 430/617
4,877,686 A * 10/1989 Riou et al. ..... 428/514
5,141,797 A * 8/1992 Wheeler ..... 428/195
5,342,729 A * 8/1994 Aono ..... 430/203
5,591,560 A * 1/1997 Fehervari et al. ..... 430/203
5,593,809 A * 1/1997 Kim et al. ..... 430/213
5,804,365 A * 9/1998 Bauer et al. ..... 430/617
5,965,347 A * 10/1999 Bauer et al. ..... 430/617
6,060,206 A * 5/2000 Hanaki et al. ..... 430/138
6,066,440 A * 5/2000 Araki et al. ..... 430/354

* cited by examiner

*Primary Examiner*—Shrive P. Beck
*Assistant Examiner*—Kirsten A. Crockford
(74) *Attorney, Agent, or Firm*—Chris P. Konkol

(57) ABSTRACT

A viscosity-increasing agent, capable of increasing the viscosity of a film-forming polymer in an image-functional layer, is preapplied in a first solution onto a web through a coating and drying process. When a second solution containing the film-forming polymer is then coated on the web, the viscosity-increasing agent diffuses through the applied second solution. As the viscosity-increasing agent interacts with the film-forming polymer during this diffusion process, the viscosity of the solution increases. The invention can be used to improve the manufacture of ink-jet media, photographic or photothermographic elements, and other imaging and image-receiving media.

5 Claims, No Drawings

METHOD FOR PROVIDING A HIGH VISCOSITY COATING ON A MOVING WEB AND ARTICLES MADE THEREBY

FIELD OF THE INVENTION

The invention relates to a method for coating a continuous web for use in making imaging or printing media, including, for example, photographic film, photothermographic film, or ink-jet media. In particular, the method is directed to controlling the viscosity of the coating during the coating process. The invention is also directed to an imaging or printing media comprising a base material made from a continuous web over which extends a coated layer made by the present method.

BACKGROUND OF THE INVENTION

In general, to form a film or coating on a flexible support, a solution containing the desired film materials is coated onto the support and dried. For high productivity and lower costs, these coatings are applied to continuous webs at high speeds and dried in an oven. Because of air impingement during drying and artifacts from the actual coating application method, coating defects may occur, for example non-uniformity in thickness and streaks. For applications that require a high degree of coating uniformity, such as high-quality photographic media, photothermographic media, or ink-jet media, this problem may be solved by using coating solutions that contain a thermoreversible gelling material such as gelatin. At high temperatures, these solutions have a low viscosity, which enables good coatability. After applying the thermoreversible gelling solution to the web, the coating is then cooled to thicken or gel the coating.

Very few materials are available that undergo a thermoreversible gelling behavior. Therefore, it would be desirable to provide a method that allows the coating of a solution containing a non-thermoreversible gelling material which has a low viscosity during the coating process and then rapidly thickens or gels once on the web. One such method is to add a thickening material to the coating solution by traditional methods, such as mix melting or simultaneous slide coating. This creates additional problems, however, especially with fast-acting thickeners. These problems include limited solution stability, delivery problems for high viscosity fluids, and a greater propensity for coating streaks due to slug formation.

Another solution to the problem of coating a web support is to use shear-thinning solutions. These solutions have a low viscosity at high shear rates (as generated during the coating process) and a high viscosity at zero/low shear rates (as encountered on the web after the coating has been applied). Because of the high viscosity at low shear rates, however, it is often difficult preparing and delivering these solutions to the coating, sometimes requiring additional manufacturing expense.

GB 2132784 to Fuji describes the use of an overcoat for heat-sensitive recording paper that comprises a mixture of poly(vinyl alcohol) and boric acid which is applied to a heat-sensitive color-forming layer. This layer contains an inorganic pigment and has a surface pH between 6 and 9. This patent does not disclose a process for modifying the viscosity of a coating solution by separate application of the poly(vinyl alcohol) and boric acid.

Thus a need exists for an improved method for manufacturing and coating imaging or printing media, wherein coating defects are reduced or eliminated in the coated film and higher coating rates are facilitated.

SUMMARY OF THE INVENTION

This invention is useful for providing coated webs with minimal or no defects, especially at higher coating speeds. Two interacting components, a first component and a second component, are selected such that when in solution together they interact with each other to increase the viscosity or to gel/crosslink the solution. The first component, a viscosity-increasing agent, is preapplied in a first solution onto the web through a coating and drying process. Then, a second solution containing the second component, a film-forming polymer used in an imaging layer or image-receiving layer, is coated on the web, after which the viscosity-increasing agent is solubilized into, and diffuses through, the applied second solution. As the above-defined first and second components interact with each other during this diffusion process, the viscosity of the solution increases. The change in viscosity can be controlled, for example, by varying the concentrations of the interacting components, by adding coating addenda such as low molecular weight diluents, or by adjusting the pH of the second solution.

An advantage of this process is the ability to coat solutions at high speeds, since the solution can be applied at a relatively low viscosity to the coating and then quickly thickened on the web. Another advantage is the ability to provide gelling or crosslinking materials to a layer without solution stability concerns.

The invention is also directed to an imaging or recording element comprising a base material made from a continuous web over which extends a coated imaging layer or image-receiving layer comprising a film-forming polymer and an amount of a viscosity-increasing agent that is higher in concentration than existed in the coating when first applied to the base material.

DETAILED DESCRIPTION OF THE INVENTION

This invention provides a method for making a coated web having uniform properties and reduced defects, even when coated at high speeds and exposed to air drying.

As used herein, the term "web," "support," or "sheet" refers to a continuous planar polymeric and/or paper material or discrete sections thereof.

The term "polyvinyl alcohol" referred to herein means a polymer having a monomer unit of vinyl alcohol as a main component.

As used herein, the term "image-functional layer" refers to a coating that produces or receives an image or is otherwise primarily and directly involved in the image formation, for example, a photosensitive or thermosensitive silver-halide emulsion or a layer that receives an image from an ink-jet printer or a layer that receives a component of the ink-jet fluid.

As used herein, the term "viscosity-increasing agent" refers to a diffusable compound that is capable of increasing the viscosity of a polymer-containing solution through the interaction of the agent with the polymer. In the case of a web used in making a photographic element, for example, the base/support preferably comprises polyester and can also comprise a conductive oxide, a lubricating agent, or a magnetic recording layer. In the case of a web used to make an ink-jet recording element, the support typically comprises on at least one surface thereof an ink-receiving (image-recording layer), and includes those intended for reflection viewing, which have an opaque support, and those intended for viewing by transmitted light, which have a transparent support.

As indicated above, two interacting components, a first component and a second component, are selected such that when in solution together they interact with each other to increase the viscosity or gel/crosslink the solution. The first component, a viscosity-increasing agent, is preapplied in a first solution onto the web through a coating and drying process. When a second solution containing the second component, a film-forming polymer used in forming an imaging or image-receiving layer, is then coated on the web, the viscosity-increasing agent is solubilized into, and diffuses through, the applied second coating solution. As the above-defined first and second components interact with each other during this diffusion process, the viscosity of the solution increases. The change in viscosity can be controlled, for example, by varying the concentrations of the interacting components, by adding coating addenda such as low molecular weight diluents, or by adjusting the pH of the second solution. At high levels, the solution can be gelled or crosslinked with this process.

The change in viscosity can be controlled, for example, by varying the concentrations of the interacting components, by adding coating addenda such as low molecular weight diluents, or by adjusting the pH of the second solution. At high levels, the solution can be gelled or crosslinked with this process.

The layers containing the first and second components may contain other materials (or themselves function as) such surfactants, and addenda necessary for creating imaging or receiving layers. The layer containing the first component may optionally contain one or more polymeric binders, and the layer containing the second component may optionally contain additional polymeric binders, for example, gelatin. In the case of an imaging element, the second component can be used as a binder in a silver-halide containing layer, either in a photographic or photothermographic element, for example, as described below. In the case of a recording element or image-receiving element, the second component can be used as a binder in the ink and/oror solvent receiving layers, for example, as described below.

In one embodiment of the invention, the first component is a borate salt such as sodium tetraborate decahydrate (borax), sodium borate, and derivatives of boric acid, boric anhydride, and the like, in combination with, as a second component, a poly(vinyl alcohol). This combination has been found to be especially advantagous for use in making photothermographic media or ink-jet media. It is known that PVA and borax interact to form a high viscosity or gelled mixture in solution which forms a crosslinked coating on drying. According to the present invention, the borax is precoated on the web and then a solution containing the PVA is applied. The water from the coating solution solubilizes the borax, thus allowing it to diffuse through the coating quickly thickening the solution. Such PVA-containing coatings are also useful, for example, as a binder in a silver-halide-containing photographic or photothermographic emulsion, as a substitute for gelatin. In the case of ink-jet and other print or image-receiving media, such coatings can be used to absorb the ink or pigments and/or the aqueous carrier fluid.

In another embodiment of the invention, a viscosity change is triggered in a coating material with a pH change, i.e. the diffusion of an acid or base into the coating material, a solution containing the polymer to be rendered viscous. One such coating material is an alkali-swellable associative thickener. Here, for example, the web can be coated with a first solution of an alkaline base (for example, sodium bicarbonate) and then an overlying second solution of the associative polymer. An example of an associative polymer is a hydrophobe modified ethoxylate urethane alkali swellable/soluble emulsion (referred to by the acronym HEURASE) as described in the *J. Oil and Color Chemists' Assoc.*, November 1993) can be coated on the web. Again, as the base diffuses through the applied coating of the second solution, the viscosity of the applied coating increases.

Other crosslinkers or gelling/thickening agents may be used to increase the viscosity of a film-forming binder, besides borax. Their effectiveness will depend on the specific application and the type of material that needs to be crosslinked. Crosslinkers that could be used include: aldehydes, dialdehydes or melamine formaldehydes such as dihydroxy dioxane, glyoxal, glutaraldehyde, methylolmelamine, di or polyfunctional isocyanates such as dicyclomethane diisocyanate, polyisocyanate based on hexamethylene diisocyanate (for example Desmodur® N3300 from Bayer), andydrides such as phthalic anhydride, maleic anhydride and its derivatives including polymers such as poly(maleic anhydride-co-styrene), di or polyfunctional aziridines such as Xama-7®, a polyfunctional aziridine from Cordova Chem, vinyl sulfones such as bisvinylsulfonyl methane, di or polyfunctional epoxies such as diepoxydecane, diepoxyoctane or Epon® resins from Shell Oil, metal alkoxides such as trimethyl borate, tetraethylorthosilicate, or titanium tetrabutoxide, and metal salts such as zinc acetate or aluminum acetate.

The film-forming copolymer or polymer includes, but is not limited to polyurethanes, polyvinyl alcohols, acrylics, polyolefins, polyesters, polyamides, polycarbonates, polyethers, polyureas, poly(vinyl halides) polysilanes, polysiloxanes and hybrids thereof, for example, polyer(esteramides)and the like. Such polymers should have interactive functional groups in order to be thicked by a second viscosity increasing agent. For example, hydroxy-containing groups in such polymers can provide such groups. The preferred polymer is polyvinyl alcohol.

Polyvinyl alcohol is typically prepared by substantial hydrolysis of polyvinyl acetate. Such a "polyvinyl alcohol" includes, for example, a polymer obtained by hydrolyzing (saponifying) the acetate ester portion of a vinyl acetate polymer (exactly, a polymer in which a copolymer of vinyl alcohol and vinyl acetate is formed), and polymers obtained by saponifying a trifluorovinylacetate polymer, a vinyl formate polymer, a vinyl pivalate polymer, a tert-butylvinylether polymer, a trimethylsilylvinylether polymer, and the like (the details of "polyvinyl alcohol" can be referred to, for example, in "World of PVA," edited by the Poval Society and published by Kobunshi Kankoukai, Japan, 1992 and "Poval", edited by Nagano et al. and published by Kobunshi Kankoukai, Japan, 1981). The degree of hydrolysis (or saponification) in the polyvinyl alcohol is preferably at least about 70% or more, more preferably at least about 80%. Percent hydrolysis refers to mole percent. For example, a degree of hydrolysis of 80% refers to polymers in which 80 mol % of all copolymerized monomer units of the polymer are vinyl alcohol units. The remainder of all monomer units consists of monomer units such as ethylene, vinyl acetate, vinyl trifluoroacetate and other comonomer units which are known for such copolymers. Polyvinyl alcohols are commercially available from a variety of sources in a variety of grades and degrees of hydrolysis, and molecular weights or degrees of polymerization. The polymerization of vinyl acetate can be conducted in any known manner without particular restriction. Usually, the polymerization is conducted in a solution polymerization manner employing as the solvent an alcohol such as methanol, ethanol or isopropanol, although an emulsion polymerization and suspension polymerization may also be adopted.

The use of the present invention in a recording element will now be described in more detail. Any support or substrate may be used in a recording element, for example, plain or calendered paper, paper coated with protective polyolefin layers, polymeric films such as poly(ethylene terephthalate), poly(ethylene naphthalate), poly(1,4-cyclohexane dimethylene terephthalate), polyvinyl chloride, polyimide, polycarbonate, polystyrene, or cellulose esters. In particular, polyethylene-coated paper or poly(ethylene terephthalate) is preferred.

The support is suitably of a thickness of from about 50 to about 500 $\mu$m, preferably from about 75 to 300 $\mu$m. Antioxidants, antistatic agents, plasticizers, dyes, pigments and other known additives may be incorporated into the support, if desired.

In order to improve the adhesion of the image-recording layer o the support, the surface of the support may be optionally subjected to a corona-discharge treatment prior to applying the image-recording layer.

Optionally, an additional backing layer or coating may be applied to the backside of a support (i.e., the side of the support opposite the side on which the image-recording layers are coated) for the purposes of improving the machine-handling properties and curl of the recording element, controlling the friction and resistivity thereof, and the like.

Typically, the backing layer may comprise a binder and a filler. Typical fillers include amorphous and crystalline silicas, poly(methyl methacrylate), hollow sphere polystyrene beads, micro crystalline cellulose, zinc oxide, talc, and the like. The filler loaded in the backing layer is generally less than 5 percent by weight of the binder component and the average particle size of the filler material is in the range of 5 to 30 $\mu$m. Typical binders used in the backing layer are polymers such as acrylates, gelatin, methacrylates, polystyrenes, acrylamides, poly(vinyl chloride)-poly(vinyl acetate) co-polymers, poly(vinyl alcohol), cellulose derivatives, and the like. Additionally, an antistatic agent also can be included in the backing layer to prevent static hindrance of the recording element. Particularly suitable antistatic agents are compounds such as dodecylbenzenesulfonate sodium salt, octyl-sulfonate potassium salt, oligostyrenesulfonate sodium salt, laurylsulfosuccinate sodium salt, and the like. The antistatic agent may be added to the binder composition in an amount of 0.1 to 15 percent by weight, based on the weight of the binder. An image-recording layer may also be coated on the backside, if desired.

Preferably, the support in a recording element is coated with a layer or layers of materials capable of absorbing the solvent (including either organic solvent or water-based carrier) for the ink. The thickness of this layer is typically from 10 to 50 $\mu$m. The material may include a hydrophilic polymer, including naturally-occurring hydrophilic colloids and gums such as gelatin, albumin, guar, xantham, acacia, chitosan, starches and their derivatives, functionalized proteins, functionalized gums and starches, and cellulose ethers and their derivatives, polyvinyloxazoline and polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers. Poly(vinyl alcohol) and its derivatives are preferred hydrophilic absorbing materials for use in ink receptive coatings. The layer may also comprise a microporous material. Preferred microporous materials are silica, alumina, or hydrated alumina, boehmite, mica, montmorillonite, kaolite,talc, vermiculite, zeolites, calcium silicate, titanium oxide, barium sulfate, and the like, optionally in combination with a polymeric binder. See, for example, U.S. Pat. No. 5,605,750, incorporated by reference. Many known microporous materials may be employed, including for example, those described in U.S. Pat. Nos. 5.032,450; 5,035,886, 5,071,645, and 5,14,438.

Typically, the solvent-absorbing material will cover the entire side of one surface of the support or substrate in the form of a separate and distinct layer. Preferably, in ink-jet media, a separate upper image-forming layer is formed. Accordingly, when the ink is ejected from the nozzle of the ink-jet printer in the form of individual droplets, the droplets pass through the upper layer where most of the dyes or pigments in the ink are retained or mordanted while the remaining dyes/pigments and the solvent or carrier portion of the ink pass freely through the upper layer to the solvent-absorbing layer where they are rapidly absorbed, for example, by a hydrophilic polymer and/or microporous material. In this manner, large volumes of ink are quickly absorbed by the recording elements, giving rise to high quality recorded images having excellent optical density and good color gaumet.

Image-forming layers in recording elements can also incorporate various known additives, including matting agents such as titanium dioxide, zinc oxide, silica, and polymeric beads such as polystyrene beads for the purposes of contributing to the non-blocking characteristics of the recording elements and to control the smudge resistance thereof; surfactants for improving the aging behavior of the ink-absorbing resin or layer, promoting the absorption and drying of a subsequently applied ink thereto, enhancing the surface uniformity of the ink-receiving layer and adjusting the surface tension of the dried coating; fluorescent dyes; pH controllers; anti-foaming agents; lubricants; preservatives; dye-fixing agents; viscosity modifiers; waterproofing agents; dispersing agents; UV absorbing agents; mordants, and the like.

If desired, a recording element can be overcoated with an ink-permeable, anit-tack, ink receptive coating, such as, for example, a hydrophilic cellulose derivative such as methyl cellulose, ethyl cellulose, hydroxyethyl cellulose, hydroxypropyl cellulose, sodium carboxymethyl cellulose, calcium carboxymethyl cellulose, methyethyl cellulose, methylhydroxyethyl cellulose, hydroxypropylmethyl cellulose, hydroxybutylmethyl cellulose, ethylhydroxyethyl cellulose, sodium carboxymethylhydroxyethyl cellulose, carboxymethylethyl cellulose, hydroxypropylmethyl cellulose phthalate, hydroxypropylmethyl cellulose acetate succinate, hydroxypropyl cellulose acetate, esters of hydroxyethyl cellulose and diallyldimethyl ammonium chloride, esters of hydroxyethyl cellulose and 2-hydroxypropyltrimethylammonium chloride and esters of hydroxyethyl cellulose and a lauryldimethylammonium substituted epoxide; as well as hydroxyethyl cellulose grafted with alkyl C12–C14 chains.

Inks used to produce an image on a recording element (for example, ink-jet media) are well known. Ink compositions used in ink-jet printing typically are liquid compositions comprising a solvent or carrier liquid, dyes or pigments, humectants, organic solvents, detergents, thickeners, preservatives and the like. The solvent or carrier liquid can be comprised solely of water or can be predominantly water mixed with water soluble solvents such as polyhydric alcohols or can be predominantly organic materials such as polyhydric alcohols. The dyes used in such compositions are typically water-soluble direct or acid type dyes. Such liquid ink compositions have been described extensively in the prior art, including, for example, U.S. Pat. No. 4,781,758.

As mentioned above, the present invention can also be used to make a an imaging element, including photothermographic, thermographic and traditional photographic elements. Many types of films, for example, x-ray or other health-imaging films, graphic-arts films, camera film, and data-recording films, employ a web comprising one or more polyester polymers as the film support, which need to be coated. Typical polyester supports comprise polyethylene terephthalate ("PET") and/or polyethylene naphthalate ("PEN"). Various copolymers and blends of polyesters, or of a polyester polymer with one or more non-polyester polymers, are also known in the art.

In one embodiment of the invention, a photothermographic element comprises at least one imaging layer containing in reactive association in a binder, preferably a binder comprising hydroxyl groups, (a) photographic silver halide prepared in situ and/or ex situ, and (b) an organic silver salt oxidizing agent, preferably a silver salt of a long chain fatty acid, such as silver behenate. The imaging element typically further comprises a reducing agent for the organic silver salt oxidizing agent. References describing such imaging elements include, for example, U.S. Pat. Nos. 3,457,075; 4,459,350; 4,264,725 and 4,741,992 and Research Disclosure, June 1978, Item No. 17029.

In the photothermographic material, it is believed that the latent image silver from the silver halide acts as a catalyst for the described image-forming combination upon processing. A preferred concentration of photographic silver halide is within the range of 0.01 to 10 moles of photographic silver halide per mole of silver behenate or other organic silver salt in the photothermographic material. Other photosensitive silver salts are useful in combination with the photographic silver halide if desired. Preferred photographic silver halides are silver chloride, silver bromide, silver bromochloride, silver bromoiodide, silver chlorobromoiodide, and mixtures of these silver halides. Very fine grain photographic silver halide is especially useful. The photographic silver halide can be prepared by any of the known procedures in the photographic art. Such procedures for forming photographic silver halides and forms of photographic silver halides are described in, for example, Research Disclosure, December 1978, Item No. 17029 and Research Disclosure, June 1978, Item No. 17643. Tabular grain photosensitive silver halide is also useful, as described in, for example, U.S. Pat. No. 4,435,499. The photographic silver halide can be unwashed or washed, chemically sensitized, protected against the formation of fog, and stabilized against the loss of sensitivity during keeping as described in the above Research Disclosure publications. The silver halides can be prepared in situ as described in, for example, U.S. Pat. No. 4,457,075, or prepared ex situ by methods known in the photographic art.

The photothermographic element typically comprises an oxidation-reduction image forming combination that contains an organic silver salt oxidizing agent, preferably a silver salt of a long chain fatty acid. Such organic silver salts are resistant to darkening upon illumination. Preferred organic silver salt oxidizing agents are silver salts of long chain fatty acids containing 10 to 30 carbon atoms. Examples of useful organic silver salt oxidizing agents are silver behenate, silver stearate, silver oleate, silver laurate, silver hydroxystearate, silver caprate, silver myristate, and silver palmitate. Combinations of organic silver salt oxidizing agents are also useful. Examples of useful organic silver salt oxidizing agents that are not organic silver salts of fatty acids are silver benzoate and silver benzotriazole.

The optimum concentration of organic silver salt oxidizing agent in the photothermographic element will vary depending upon the desired image, particular organic silver salt oxidizing agent, particular reducing agent and particular photothermographic element. A preferred concentration of organic silver salt oxidizing agent is within the range of 0.1 to 1 00 moles of organic silver salt oxidizing agent per mole of silver in the element. When combinations of organic silver salt oxidizing agents are present, the total concentration of organic silver salt oxidizing agents is preferably within the described concentration range.

A variety of reducing agents are useful in the photothermographic element. Examples of useful reducing agents in the image-forming combination include substituted phenols and naphthols, such as bis-beta-naphthols; polyhydroxybenzenes, such as hydroquinones, pyrogallols and catechols; aminophenols, such as 2,4-diaminophenols and methylaminophenols; ascorbic acid reducing agents, such as ascorbic acid, ascorbic acid ketals and other ascorbic acid derivatives; hydroxylamine reducing agents; 3-pyrazolidone reducing agents, such as 1-phenyl-3-pyrazolidone and 4-methyl-4-hydroxymethyl-1-phenyl-3-pyrazolidone; and sulfonamidophenols and other organic reducing agents known to be useful in photothermographic elements, such as described in U.S. Pat. No. 3,933,508, U.S. Pat. No. 3,801,321 and Research Disclosure, June 1978, Item No. 17029. Combinations of organic reducing agents are also useful in the photothermographic element.

Preferred organic reducing agents in the photothermographic element are sulfonamidophenol reducing agents, such as described in U.S. Pat. No. 3,801,381. Examples of useful sulfonamidophenol reducing agents are 2,6-dichloro-4-benzenesulfonamidophenol; benzenesulfonamidophenol; and 2,6-dibromo-4-benzenesulfonamidophenol, and combinations thereof.

An optimum concentration of organic reducing agent in the photothermographic element varies depending upon such factors as the particular photothermographic element, desired image, processing conditions, the particular organic silver salt oxidizing agent, and the particular polyalkoxysilane.

The photothermographic element preferably comprises a toning agent, also known as an activator-toner or toner-accelerator. Combinations of toning agents are also useful in the photothermographic element. Examples of useful toning agents and toning agent combinations are described in, for example, Research Disclosure, June 1978, Item No. 17029 and U.S. Pat. No. 4,123,282. Examples of useful toning agents include, for example, phthalimide, N-hydroxyphthalimide, N-potassium-phthalimide, succinimide, N-hydroxy-1,8-naphthalimide, phthalazine, 1-(2H)-phthalazinone and 2-acetylphthalazinone.

Post-processing image stabilizers and latent image keeping stabilizers are useful in the photothermographic element. Any of the stabilizers known in the photothermographic art are useful for the described photothermographic element. Illustrative examples of useful stabilizers include photolytically active stabilizers and stabilizer precursors as described in, for example, US. Pat. No. 4,459,350. Other examples of useful stabilizers include azole thioethers and blocked azolinethione stabilizer precursors and carbamoyl stabilizer precursors, such as described in U.S. Pat. No. 3,877,940.

The thermally processable elements as described preferably contain a vehicle or binder, which in one embodiment of the present invention, may be polyvinyl alcohol, alone or in combination with other vehicles or binders in various layers. Other optional synthetic polymeric compounds that are useful include dispersed vinyl compounds such as in latex form and particularly those that increase dimensional stability of photographic elements. Effective polymers include water insoluble polymers of acrylates, such as alkylacrylates and methacrylates, acrylic acid, sulfoacrylates; poly(vinyl butyral), cellulose acetate butyrate, poly (vinylpyrrolidone), ethyl cellulose, polystyrene, poly (vinylchloride), chlorinated rubbers, polyisobutylene, butadiene-styrene copolymers, copolymers of vinyl chloride and vinyl acetate, copolymers of vinylidene chloride and vinyl acetate, and polycarbonates.

Photothermographic elements and thermographic elements as described can contain addenda that are known to aid in formation of a useful image. The photothermographic element can contain development modifiers that function as speed increasing compounds, sensitizing dyes, hardeners, antistatic agents, plasticizers and lubricants, coating aids, brighteners, absorbing and filter dyes, such as described in Research Disclosure, December 1978, Item No. 17643 and Research Disclosure, June 1978, Item No. 17029.

The layers of the thermally processable element are coated on a support by coating procedures known in the photographic art, including dip coating, air knife coating, curtain coating or extrusion coating using hoppers. If desired, two or more layers are coated simultaneously.

Spectral sensitizing dyes are useful in the photothermographic element to confer added sensitivity to the element. Useful sensitizing dyes are described in, for example, Research Disclosure, June 1978, Item No. 17029 and Research Disclosure, December 1978, Item No. 17643.

The thermally processable elements are exposed by means of various forms of energy. In the case of the photothermographic element such forms of energy include those to which the photographic silver halides are sensitive and include ultraviolet, visible and infrared regions of the electromagnetic spectrum as well as electron beam and beta radiation, gamma ray, x-ray, alpha particle, neutron radiation and other forms of corpuscular wave-like radiant energy in either non-coherent (random phase) or coherent (in phase) forms produced by lasers. Exposures are monochromatic, orthochromatic, or panchromatic depending upon the spectral sensitization of the photographic silver halide. Imagewise exposure is preferably for a time and intensity sufficient to produce a developable latent image in the photothermographic element.

After imagewise exposure of the photothermographic element, the resulting latent image is developed merely by overall heating the element to thermal processing temperature. This overall heating merely involves heating the photothermographic element to a temperature within the range of about 90° C. to 180° C. until a developed image is formed, such as within about 0.5 to about 60 seconds. By increasing or decreasing the thermal processing temperature a shorter or longer time of processing is useful. A preferred thermal processing temperature is within the range of about 100° C. to about 130° C.

In the case of a thermographic element, the thermal energy source and means for imaging can be any imagewise thermal exposure source and means that are known in the thermographic imaging art. The thermographic imaging means can be, for example, an infrared heating means, laser, microwave heating means or the like.

Heating means known in the photothermographic and thermographic imaging arts are useful for providing the desired processing temperature for the exposed photothermographic element. The heating means is, for example, a simple hot plate, iron, roller, heated drum, microwave heating means, heated air or the like.

Thermal processing is preferably carried out under ambient conditions of pressure and humidity. Conditions outside of normal atmospheric pressure and humidity are useful.

The components of the photothermographic element can be in any location in the element that provides the desired image. If desired, one or more of the components can be in more than one layer of the element. For example, in some cases, it is desirable to include certain percentages of the reducing agent, toner, stabilizer and/or other addenda in the overcoat layer over the photothermographic imaging layer of the element. This, in some cases, reduces migration of certain addenda in the layers of the element.

A photothermographic element preferably includes a backing layer. The backing layer utilized in this invention is an outermost layer and is located on the side of the support opposite to the imaging layer. It is typically comprised of a binder and a matting agent which is dispersed in the binder in an amount sufficient to provide the desired surface roughness.

A wide variety of materials can be used to prepare a backing layer that is compatible with the requirements of a photothermographic element. The backing layer should be transparent and colorless and should not adversely affect sensitometric characteristics of the photothermographic element such as minimum density, maximum density and photographic speed. Preferred backing layers are those comprised of poly(silicic acid) and a water-soluble hydroxyl containing monomer or polymer that is compatible with poly(silicic acid) as described in U.S. Pat. No. 4,828,971. A combination of poly(silicic acid) and poly(vinyl alcohol) is particularly useful. Other useful backing layers include those formed from polymethylmethacrylate, cellulose acetate, crosslinked polyvinyl alcohol, terpolymers of acrylonitrile, vinylidene chloride, and 2-(methacryloyloxy) ethyltrimethylammonium methosulfate, crosslinked gelatin, polyesters and polyurethanes.

In photothermographic imaging elements, either organic or inorganic matting agents can optionally be used. Examples of organic matting agents are particles, often in the form of beads, of polymers such as polymeric esters of acrylic and methacrylic acid, e.g., poly (methylmethacrylate), styrene polymers and copolymers, and the like. Examples of inorganic matting agents are particles of glass, silicon dioxide, titanium dioxide, magnesium oxide, aluminum oxide, barium sulfate, calcium carbonate, and the like. Matting agents and the way they are used are further described in U.S. Pat. Nos. 3,411,907 and 3,754,924.

The thermally processable imaging element of this invention preferably includes an overcoat on the imaging layer. Preferred overcoats are those comprised of poly(silicic acid) and a water-soluble hydroxyl containing monomer or polymer that is compatible with the poly(silicic acid) as described in U.S. Pat. No. 4,741,992. An overcoat comprised of poly(vinyl alcohol) and colloidal silica or colloidal alumina is particularly useful. Other preferred overcoats are described in Research Disclosure, June 1978, Item No. 17029.

Thermophotographic or thermographic elements can be single color elements or multicolor elements. Multicolor elements contain image dye-forming units sensitive to each of the three primary regions of the spectrum. Each unit can comprise a single imaging layer or multiple imaging layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor thermophotographic or thermographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

The entire contents of the various patents and other publications cited in this specification are incorporated herein by reference.

In manufacturing biaxially-oriented film base for any photographic or photothermographic imaging element, a thermoplastic resin is typically extruded as a relatively thick, high-viscosity, molten ribbon onto a moving receiver surface, typically a polished casting wheel. The temperature of the ribbon may be adjusted, and then the ribbon is stretched in the machine direction (MD orientation), or "drafted", and stretched in the transverse direction (TD orientation), or "tentered" in known fashion to biaxially orient the molecules of the polymer and to achieve the desired final width and thickness of the ribbon as a web or sheet.

To enhance the crystallinity and to increase the dimensional stability of the web, the biaxially-oriented polymeric web is "heat-set" by heating it above its glass transition temperature ($T_g$) to near its crystallization point, while maintaining the web under constant tension. The heating and tensioning also ensure that the heat-set film remains transparent upon cooling. To reduce residual stresses and improve planarity after being heat-set, the web may be subjected to a period, typically several minutes, of temperature above $T_g$ but below the heat-set temperature, a process known as "heat relaxation." Typically, the web is rapidly cooled following each of the heat set and heat relax steps to lock in the desired properties. Following heat relaxation, the web is wound into a stock roll of desired length in preparation for subsequent coating of photographic layers. Details of the manufacture of polyester webs are disclosed in, for example, U.S. Pat. Nos. 2,779,684, 4,141,735, and 5,895,744.

The present invention can be practiced on such conventional apparatus used in the coating and drying industry. For example, in the case of a photographic film, a web coating machine conveys a web substrate over rollers, which may be either idle rollers or drive rollers, and around a coating backing roller which supports the web for the application of a liquid coating via an applicator. Application can be made by any of various known coating applicators, for example, slot die hopper, suction slide hopper also known as a cascade hopper, curtain coating hopper, extrusion/slide hopper, air knife metered applicator, kiss coater, fountain applicator, gravure roller, and offset roller. After application of the liquid coating, the web passes through a series of dryers to remove the solvent from the layer.

The present coating process can be applied in combination with conventional web making technology well known to one of ordinary skill in the art. For example, in the case of photographic-film support, manufacturing typically involves a a feeder or conveyor that supplies pellets of a feedstock comprising polyester polymer or a blend of polyester and non-polyester polymers to a screw extruder which liquefies the pellets by progressive heating and compression and extrudes a continuous ribbon of high-viscosity, molten polymer from an extrusion die onto a moving receiver, typically a polished casting wheel, on which the ribbon may be tempered to a lower temperature than the casting temperature. Typically, the ribbon is much narrower and ten times or more thicker than the finished web. The tempered ribbon is stripped from the moving receiver and is stretched longitudinally (drafted) in a conventional machine-direction orienter (MDO) and transversely (tentered) in a conventional transverse-direction orienter (TDO) to provide a web of the desired width and finished thickness, a process known as "orientation" of the web. The order of longitudinal and transverse stretchings may be reversed. After orientation, the properly-dimensioned web is heat set in a heat-setting section at a first temperature above $T_g$ of the resin and below the crystallization temperature. Heating can be anywhere from a few seconds up to 1 minute.

A latex undercoat, or primer, may be applied to the ribbon prior to orientation to provide satisfactory adhesion of aqueous gelatin layers such as a subbing layer or photographic emulsions when coated subsequently in a photographic coating machine.

In accordance with the present invention, the surface of the web is then coated with a solution comprising a viscosity-increasing agent to form a preliminary layer, which is then dried by an oven or other heating means. The preliminary layer on the web is subsequently coated with a second solution comprising a film-forming polymer (as described above) to form a image-functional layer providing preselected properties in the final product, wherein an effective amount of the viscosity-increasing agent in the preliminary layer solubilizes and diffuses into the image-functional layer to interact with the film-forming polymer to increase its viscosity.

All of the said coating steps may be carried out within a single continuous-process machine or the image-functional layer may be applied in a second coating operation. For light sensitive layers, such as photothermographic layers, it is preferred that the photographic elements be applied in a separate coating operation.

After the coating is dried, the coated web may be heat relaxed in heat relaxation apparatus, which typically includes an insulated chamber having a sinuous web path provided with hot air or radiant heating whereby the web is maintained at a second temperature above the $T_g$ of the polyester polymer or polymer blend, but below the heat-set temperature, for a period of up to 10 minutes. Heat relaxation improves the planarity of the web, and also improves the adhesion of the coated layer. Following heat relaxation, the web may be wound with a conventional winder into individual stock rolls.

In applications not involving an oriented web, the web-making operation may consist of extruding the ribbon into a nip between opposed rollers, preferably in a train of a plurality of nip rollers, wherein the ribbon is progressively widened and thinned to desired web dimensions. Biaxial stretching is omitted. Such non-oriented web generally is not suitable for photographic support; however, aqueous coatings may be made thereto by treating as herein described.

In another embodiment, the web material comprises paper, such as conventional paper, calendared paper, paper coated with extruded protective layers such as polyethylene, polypropylene or the like, and opaque or non-opaque polymeric films.

In addition to the above-described method of use, the present invention is also directed to the imaging element made by such a method. The imaging element comprises a support that is cut from a continuous web and a polymeric layer applied onto the continuous web, which layer comprises an effective amount of a viscosity-increasing agent, but wherein the amount of viscosity-increasing agent in the polymeric layer material is higher than existed in the coating when first applied to the web. In one embodiment, the imaging element comprises a layer having greater than 30 weight percent polyvinyl alcohol wherein the weight percent of borax based on the weight of polyvinyl alcohol is greater than 0.3%, in the dried coating. Preferably, the dried coating comprises 30 to 100 weight percent polyvinyl alcohol wherein the molar ratio of hydroxyl groups in the film-forming polymer to boron from the borate salt is 50/1 to 2600/1, more preferably 131/1 to 500/1 mole ratio of hydroxyl groups to boron and most preferred 200/1 to 500/1, in the dried coating. In the case of an ink-jet media, the base is preferably made from paper or polyester and an overlying polymeric layer.

EXAMPLE 1

To demonstrate the diffusion/thickening process, a parallel plate viscometry experiment was performed using borax as the thickening agent for a polyvinyl alcohol solution.

Preparation of Plates:

A solution containing 5 wt % borax (sodium borate decahydrate) and 1% poly(vinyl pyrrolidinone) K90 (from ISP) was spin coated onto a 3.5 inch×3.5 inch mirror aluminum plate for 2 min at 320 rpm. PVP is used as a binder for the borax to aid in coating and to prevent dusting or crystallization of the borax after drying. The amount of borax on the plate was determined to be 0.47 g/m$^2$ by dissolving the coating in a known volume of water and then analyzing the water solution for boron with inductively coupled plasma-atomic emission spectroscopy. The concentration of borax on the plate was varied by changing either spin conditions or the concentration of borax in the solution. For this example a plate with 0.80 g/m$^2$ of borax was also prepared. The starting viscosity of the PVA solution was 0.018 Pa sec.

The coated plate was used as the bottom plate in a Bohlin Instruments CVO Rheometer with the parallel plate set up using a 500 micron gap between plates and a 40 mm diameter top plate. A 4% poly(vinyl alcohol) solution (Elvanol® 52-22 from DuPont, 88% hydrolyzed) was placed in the rheometer, and the viscosity as a function of time was recorded using a constant applied stress of 10 Pa at 25° C. The results are presented in Table 1 below.

TABLE 1

| Borax Conc. on Plate (g/m$^2$) | Viscosity at indicated time in units of Pascal-seconds | | | | | |
|---|---|---|---|---|---|---|
| | 10 sec | 50 sec | 100 sec | 200 sec | 300 sec | >1000 sec |
| 0.47 | 0.033 | 0.052 | 0.086 | 0.217 | 0.837 | 3.82 |
| 0.80 | 0.025 | 0.042 | 0.324 | 13.20 | 30.40 | 48.30 |

The above results show that as the borax diffuses through the solution, the viscosity increases, and the magnitude of the viscosity change can be controlled with borax concentration.

EXAMPLE 2

This is similar to Example 1 except that the concentration of PVA in the solution was varied and the amount of borax on the plate was 0.47 g/m$^2$. The results are presented in Table 2 below.

TABLE 2

| % PVA | Viscosity at indicated time in units of Pascal-seconds | | | | | | |
|---|---|---|---|---|---|---|---|
| | 3 sec | 10 sec | 50 sec | 100 sec | 200 sec | 400 sec | >1000 sec |
| 3.58 | 0.03 | 0.03 | 0.43 | 0.10 | 1.53 | 13.6 | 15.0 |
| 3.86 | 0.03 | 0.03 | 0.06 | 0.11 | 0.94 | 11.8 | 12.9 |
| 4.17 | 0.02 | 0.02 | 0.04 | 0.70 | 0.24 | 4.2 | 10.6 |

The results above show that viscosity change with diffusion can be altered by varying the PVA concentration.

EXAMPLE 3

This example is similar to Example 2 except that a photothermographic emulsion with PVA was used as the solution in the rheometer. The emulsion contains 3.6% of the PVA in water and other addenda such as silver behenate, silver bromide, succimide, developer, which make up another 11.7% solids in water. The results are presented in Table 3. The starting viscosity of the emulsion was 0.214 Pa sec at a temperature of 25° C.

TABLE 3

| Borax Conc. on Plate (g/m$^2$) | Viscosity at indicated time in units of Pascal-seconds | | | | | |
|---|---|---|---|---|---|---|
| | 10 sec | 50 sec. | 100 sec. | 200 sec. | 300 sec. | >1000 sec. |
| 0.47 | 0.31 | 0.69 | 2.47 | 9.42 | 12.4 | 12.5 |

These show that the viscosity quickly rises and is >2 Pa sec in less than 100 sec at 25° C. For coating operations that use thermoreversible gelling materials, it is desirable to have a viscosity >1 Pa sec within 100 sec; therefore this PVA/borax diffusion system provides similar viscosity changes compared to traditional materials such as gelatin.

EXAMPLE 4

This Example illustrates the determination of the borax distribution through a coating.

Preparation of Pre-coated Borax Web:

First a solution containing 0.833% borax and 0.093% PVP K90 and 0.02% Olin® 10 G (surfactant) in water was prepared. This was applied to a 100 micron PET web at 12.91 cc/m$^2$ wet coverage using standard coating methods and dried. This provides a precoating of borax and PVP on the PET web at 0.11 g/m$^2$ and 0.012 g/m$^2$, respectively. To this web, two different solutions were prepared and coated on the web, both resulting in a dry coverage of PVA of 3.3 g/m$^2$. One solution (A) contained only PVA and the second (B) was a photothermographic emulsion (with silver) as described above.

Two control coatings were prepared by coating a PVA solution (C) and a PVA/borax solution (D) on a PET web with no borax preapplied. The resulting dry coverage of solution C was 3.3 g/m$^2$. Solution D gave a dry coverage of 3.3 g/m$^2$ of PVA and 0.11 g/m$^2$ of borax. (See Table 4 below.)

The coatings from these four solutions were analyzed using dynamic secondary ion mass spectroscopy to depth profile the amount of boron through the thickness. Coating C showed no boron as expected. The profiles of boron versus depth for coatings A and D were equivalent showing that the distribution of boron (or borax) by the diffusion process is equivalent to directly adding the borax to the coating solution. For coating B, the distribution of boron in the coating was the same as the distribution of the silver in the photographic emulsion; again demonstrating the uniformity of the borax by diffusion.

TABLE 4

| Solution | Dry Coating | Borax (0.11 g/m$^2$) |
|---|---|---|
| A | 3.3 g/m$^2$ PVA | Yes |
| B | Emulsion (PVA + Ag) | Yes |
| C | 3.3 g/m$^2$ PVA | No |
| D | 3.3 g/m$^2$ PVA + 0.11 g/m$^2$ borax | No |

EXAMPLE 5

An ink-receptive coating comprising two layers was formed as follows: the base layer coating composition was a 10% solids solution of polyvinyl alcohol (Elvanol® 52/22; DuPont Packaging and Industrial Polymers) and mordant in a ratio of 75/25 by weight. The mordant is a copolymer of vinylbenzyl trimethyl ammonium chloride: divinyl benzene in a molar ratio of 87:13. The overcoat coating composition was a 5% solids combination of fumed alumina (CEP10AK97003, Cabot Corporation) and polyvinyl alcohol (Elvanol 52/22, DuPont Packaging and Industrial Polymers) in a ratio of 90/10 by weight. The overcoat coating composition contained a coating aid at a level of 0.05% active by weight (10 G, Dixie Chemical).

A two-layer coating structure was simultaneously deposited by bead coating and dried by forced air heating in order to yield a base layer having a dry coverage of 15 g/m$^2$ and an overcoat coverage of 1.1 g/m$^2$.

The above ink-receptive coating structure was deposited on a poly(ethylene terephthalate) support which had been previously coated with a borax/PVP coating. This borax/PVP coating was prepared by first preparing a solution containing 0.833% borax and 0.093% PVP K90 and 0.02% Olin 10 G in water. This was applied to a 100 micron PET web at 12.91 cc/m$^2$ wet coverage using standard coating methods and dried. This provides a precoating of borax and PVP on the PET web at 0.11 g/m$^2$ and 0.012 g/m$^2$, respectively.

For comparison, the same ink receptive structure as above was coated on a poly(ethylene terphthalate) support having an adhesion promoting layer consisting of a terpolymer of acrylonitrile/vinylidene chloride/acrylic acid. To evaluate the time required for an inkjet image to dry, a test target consisting of narrow bars of differing optical densities was printed on the ink receptive examples described above using a Kodak 1200® Distributed Medical Imager. The bars making up the test target had specified % black coverages of 100, 87, 71, 55 and 41, as defined by Adobe Photoshop® software. Immediately after printing, a sheet of bond paper was place in contact with the printed image and compressed in an even fashion by rolling with a heavy polished bar. The image and bond paper were immediately separated and the bond paper inspected for ink offset. The print time for the target was 189 seconds, so the ratio of the length of the offset colorant on the bond paper to the length of the original printed bars was used to calculate the dry time for each shade of black. The ambient conditions during testing were 24 C, 52% relative humidity.

The time for each bar to dry is summarized below in Table 5.

TABLE 5

| | 100% Black | 87% Black | 71% Black | 55% Black | 41% Black |
|---|---|---|---|---|---|
| Example | 128 seconds | 2 seconds | 0 | 0 | 0 |
| Comparative Example | >189 seconds | >189 seconds | 110 seconds | 0 | 0 |

This data shows that by crosslinking the ink-receiving layer with borax, the dry time improves substantially. The poly(vinyl alcohol) layer is effectively crosslinked by the borax-containing underlayer during the coating process such that its rigidity when wet is improved, yet the crosslinking is not so pronounced that the image-receiving layer loses its ink absorption efficiency.

An additional benefit is that when an ink-receptive layer is crosslinked as described here, reticulation due to subsequent wetting during the inkjet printing operation is also substantially improved.

EXAMPLE 6

This example illustrates the thickening of a urethane-containing solution according to the present invention. A solution containing 8% sodium bicarbonate, 8% PVP and 0.1% Olin® 10 G surfactant in water was spin coated onto an aluminum plate as describe above. This provides a plate that will release a base (sodium bicarbonate) when dissolved and then can diffuse through an applied solution.

The sodium bicarbonate coated plate was used as the bottom plate in the parallel plate rheometer (500 micron gap). A 5% solution of UCAR Polyphobe® TR-116 (from Union Carbide) was placed in the gap and the viscosity followed with time. TR-116 is a urethane functional alkali swellable material that is used as an associative thickener or rheology modifier. At low pH's (<6) solutions with the material have a low viscosity. In basic solutions the material swells and associates, thereby increasing the viscosity of the solution.

The data in Table 6 below shows that a low viscosity solution can be applied to a surface and through the diffusion of a small molecule, increase the viscosity.

TABLE 6

| Sodium Bicarbonate on Plate ($g/m^2$) | Viscosity at indicated time in units of Pascal-seconds | | | | | |
|---|---|---|---|---|---|---|
| | 5 sec | 50 sec. | 100 sec. | 200 sec. | 400 sec. | 800 sec. |
| 0.88 | 0.02 | 0.03 | 0.25 | 1.82 | 5.28 | 12.1 |

EXAMPLE 7

This example illustrates viscosity increase during coating in a method according to the present invention. A pre-coated borax web was prepared as described in Example 4, resulting in a dry coverage of borax on the web of 0.11 $g/m^2$. On top of this borax coating, a solution of a photothermographic emulsion (described in Example 3) was applied using standard extrusion coating methods. For coating, the emulsion was warmed to 40° C, and applied on the web at a wet coverage of 80.7 $cc/m^2$ at a coating speed of 15.2 m/min. A "finger transfer test" was used to determine if the emulsion coating was "gelled" or thickened. For this evaluation, at different distances from the coating application point (or equivalent time), one would rub their finger on the coating to determine if the solution was gelled or still fluid. It was determined that an emulsion applied over a borax coating was gelled in about 2 sec. after coating. For comparison, the same emulsion was applied to a PET support without a borax pre-coating. This coating remained fluid until the water was removed from the coating using standard drying methods which was greater than 10 sec.

The many features and advantages of the invention are apparent from the detailed specification and thus it is intended by the appended claims to cover all such features and advantages which fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. A method for coating a polyester web in a photothermographic element comprising:

(a) coating a surface of said polyester web, optionally precoated with one or more previous coating layers, with a first liquid composition comprising a borate salt and a binder to form a preliminary coating, (b) drying the preliminary coating, and (c) coating said web with a second liquid composition comprising polyvinyl alcohol to form a photosensitive image-functional emulsion layer for the photothermographic element, wherein said borate salt is solubilized into the second liquid composition and interacts with the polyvinyl alcohol to form a crosslinked mixture having an increased viscosity on drying, such that the second liquid composition quickly thickens after application, wherein the polyester web comprises a thermoplastic resin selected from the group consisting of polyethylene terephthalate and polyethylene naphthalate, and blends thereof.

2. A method in accordance with claim 1 wherein the polymeric binder is gelatin.

3. A method for making a photothermographic imaging element comprising:

(a) coating the surface of a polyester web, optionally pre-coated with one or more previous coating layers, with a first liquid composition comprising a borate salt and gelatin to form a first coating, wherein the borate salt coverage on the web is greater than 10 $mg/m^2$, (b) drying the first coating, (c) coating said first coating with a second liquid composition comprising polyvinyl alcohol and photothermographic imaging materials, including a reducing agent in association with an organic silver salt oxidizing agent, wherein said borate salt is solubilized into the second liquid composition and interacts with the polyvinyl alcohol to form a liquid having an increased viscosity on the web, such tat the coating quickly thickens; and (d) drying the second coating.

4. A method in accordance with claim 3 wherein all of said steps are carried out within a single continuous-process machine.

5. A method in accordance with claim 3 wherein steps (a) to (b) are not carried out continuously with step (c).

* * * * *